US008438868B2

(12) United States Patent
Lee et al.

(10) Patent No.: US 8,438,868 B2
(45) Date of Patent: May 14, 2013

(54) REFRIGERATOR

(75) Inventors: Dong Hoon Lee, Seoul (KR); Kyung Han Jeong, Seoul (KR); Wook Yong Lee, Seoul (KR); Joon Hwan Oh, Seoul (KR); Il Wook Joung, Seoul (KR)

(73) Assignee: LG Electronics Inc., Seoul (KR)

( * ) Notice: Subject to any disclaimer, the term of this patent is extended or adjusted under 35 U.S.C. 154(b) by 286 days.

(21) Appl. No.: 12/877,711

(22) Filed: Sep. 8, 2010

(65) Prior Publication Data

US 2011/0067429 A1 Mar. 24, 2011

Related U.S. Application Data

(63) Continuation-in-part of application No. 12/585,795, filed on Sep. 24, 2009, now Pat. No. 8,322,158.

(30) Foreign Application Priority Data

Sep. 3, 2009 (KR) ..... 10-2009-0083006

(51) Int. Cl.
*F25C 5/02* (2006.01)

(52) U.S. Cl.
USPC ..... 62/320; 62/344

(58) Field of Classification Search ..... 62/340, 62/343, 344, 137
See application file for complete search history.

(56) References Cited

U.S. PATENT DOCUMENTS

| | | | | |
|---|---|---|---|---|
| 3,926,414 | A * | 12/1975 | Tanguy | 366/142 |
| 4,092,834 | A * | 6/1978 | Lloyd | 62/123 |
| 4,176,527 | A | 12/1979 | Linstromberg et al. | |
| 4,796,441 | A * | 1/1989 | Goldstein | 62/354 |
| 4,972,999 | A | 11/1990 | Grace | |
| 5,056,688 | A | 10/1991 | Goetz et al. | |
| 6,030,283 | A * | 2/2000 | Anderson | 451/558 |
| 6,082,130 | A | 7/2000 | Pastryk et al. | |
| 6,425,259 | B2 | 7/2002 | Nelson et al. | |
| 7,631,513 | B2 * | 12/2009 | Chung et al. | 62/320 |
| 7,743,622 | B2 | 6/2010 | Fischer et al. | |
| 7,762,097 | B2 * | 7/2010 | Jeong et al. | 62/340 |
| 2005/0072167 | A1 * | 4/2005 | Oh | 62/137 |
| 2006/0117784 | A1 * | 6/2006 | Yang | 62/340 |
| 2006/0202071 | A1 | 9/2006 | Jung et al. | |
| 2006/0202072 | A1 | 9/2006 | Lee et al. | |
| 2006/0213213 | A1 * | 9/2006 | Chung et al. | 62/344 |
| 2006/0242971 | A1 * | 11/2006 | Cole et al. | 62/66 |

(Continued)

FOREIGN PATENT DOCUMENTS

| | | |
|---|---|---|
| JP | 56-47453 | 4/1981 |
| JP | 56-47454 | 4/1981 |

*Primary Examiner* — Mohammad Ali

(74) *Attorney, Agent, or Firm* — McKenna Long & Aldridge LLP

(57) ABSTRACT

A refrigerator includes an ice maker to make pieces of ice and an ice storage bin to receive the pieces of ice made by the ice maker. A plurality of blades is rotatably disposed at a bottom portion of the ice storage bin and an ice separating device to separate clumped pieces of ice discharged from the ice maker is disposed in the ice storage bin between the ice maker and the plurality of blades, where the ice separating device is disposed on at least a rear wall, a front wall, or a side wall of the ice storage bin.

19 Claims, 20 Drawing Sheets

U.S. PATENT DOCUMENTS

| | | | | |
|---|---|---|---|---|
| 2007/0079626 | A1* | 4/2007 | Comerci et al. | 62/340 |
| 2007/0084230 | A1 | 4/2007 | Krause et al. | |
| 2007/0214825 | A1* | 9/2007 | Jeong et al. | 62/344 |
| 2008/0134709 | A1 | 6/2008 | Fischer et al. | |
| 2008/0156016 | A1 | 7/2008 | Jeong et al. | |
| 2008/0295536 | A1 | 12/2008 | Kim et al. | |
| 2008/0295538 | A1 | 12/2008 | Kim et al. | |
| 2009/0145157 | A1 | 6/2009 | Jeong et al. | |

* cited by examiner

Section A

REFRIGERATOR

CROSS-REFERENCE TO RELATED APPLICATION

This application claims the benefit of Korean Patent Application No. 10-2009-0083006, filed on Sep. 3, 2009, and is a continuation-in-part of application Ser. No. 12/585,795 filed Sep. 24, 2009, both of which are hereby incorporated by reference in its entirety as if fully set forth herein.

BACKGROUND

1. Field of the Disclosure

The present disclosure relates to a refrigerator, and more particularly, to a refrigerator wherein clumped pieces of ice may be separated as individual pieces of ice in an ice storage bin.

2. Discussion of the Related Art

A refrigerator is a home appliance that is able store and preserve food by cooling or freezing the food using a refrigeration cycle including compression, condensation, expansion, and evaporation.

The refrigerator generally includes a refrigerator body having a storage chamber, a door mounted to the refrigerator body to open and close an opening of the refrigerator body, and an ice maker provided at the storage chamber or at the door.

At the storage chamber or the door, an ice storage bin is provided to store ice discharged from the ice maker. The ice storage bin is connected to a dispenser that dispenses ice from the refrigerator according to user selection.

SUMMARY

There may be instances where two or more pieces of ice moving downward vertically from the ice maker are clumped together. Also, these clumped pieces of ice may occur during storage in the ice storage bin. These clumped pieces of ice may hinder with the operation of rotary blades of an ice discharge member in the ice storage bin as the rotary blades are usually designed to crush or discharge one ice piece at a time. Accordingly, it is desirable to separate these clumped pieces into individual ice pieces prior to being operated on by the rotary blades of the ice discharge member.

Accordingly, a refrigerator that substantially obviates one or more problems due to limitations and disadvantages of the related art is highly desirable.

For instance, one object is to provide an ice separating device in the ice storage bin that can separate clumped pieces of ice into individual pieces of ice.

Additional advantages, objects, and features will be set forth in part in the description which follows and in part will become apparent to those having ordinary skill in the art upon examination of the following or may be learned from practice of the disclosure. Many objectives and advantages may be realized and attained by structures particularly pointed out in the written description and claims hereof as well as the appended drawings.

To achieve these objects and other advantages, as embodied and broadly described herein, a refrigerator includes an ice maker to make pieces of ice; an ice storage bin to receive the pieces of ice made by the ice maker; a plurality of blades rotatably disposed at a bottom portion of the ice storage bin; and an ice separating device to separate clumped pieces of ice discharged from the ice maker, the ice separating device disposed in the ice storage bin between the ice maker and the plurality of blades, wherein the ice separating device is disposed on at least a rear wall, a front wall, or a side wall of the ice storage bin.

In another aspect, a refrigerator includes a drive motor; an ice maker to make pieces of ice; an ice storage bin to receive the pieces of ice made by the ice maker; a plurality of blades rotatably disposed at a wall of the ice storage bin; and an ice separating device to separate clumped pieces of ice in the ice storage bin, the ice separating device disposed in the ice storage bin between the ice maker and the plurality of blades, wherein the ice separating device is disposed on the same wall as the plurality of blades, and the ice separating device and the plurality of blades are driven together by the drive motor.

It is to be understood that both the foregoing general description and the following detailed description are exemplary and explanatory and are not intended to limit the scope of the claims.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principles of the invention. In the drawings.

DETAILED DESCRIPTION OF THE EXEMPLARY EMBODIMENTS

Reference will now be made in detail to the exemplary embodiments of the present invention, examples of which are illustrated in the accompanying drawings. Wherever possible, the same reference numbers will be used throughout the drawings to refer to the same or like parts.

Figure 1:
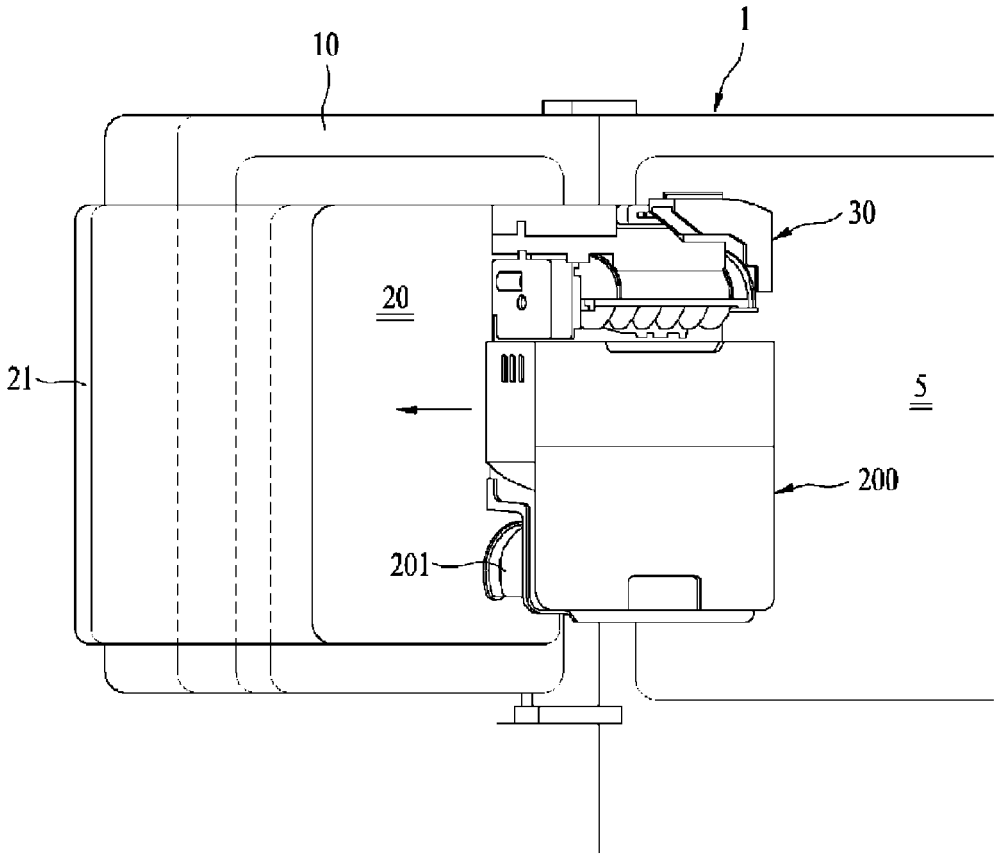
FIG. 1 is a view showing a refrigerator according to an embodiment of the present invention having an ice storage bin and an ice maker mounted therein.

As shown in FIG. 1, a refrigerator according to an embodiment of the present invention includes a refrigerator body 1 having a storage chamber 5 defined therein and a door 10 hingedly mounted to the refrigerator body 1 to open and close the storage chamber 5.

An ice making chamber 20 is formed at an inner surface of the door 10. At the ice making chamber 20, an ice maker 30 is provided to make ice and an ice storage bin 200 is provided to store ice discharged from the ice maker 30.

At the rear of the ice storage bin 200, a drive motor 201 is provided to drive an ice discharge member 300 (See FIG. 2) provided in the ice storage bin 200.

An ice making chamber door 21 is provided at one side of the ice making chamber 20 to selectively open and close the ice making chamber 20.

Figure 2:
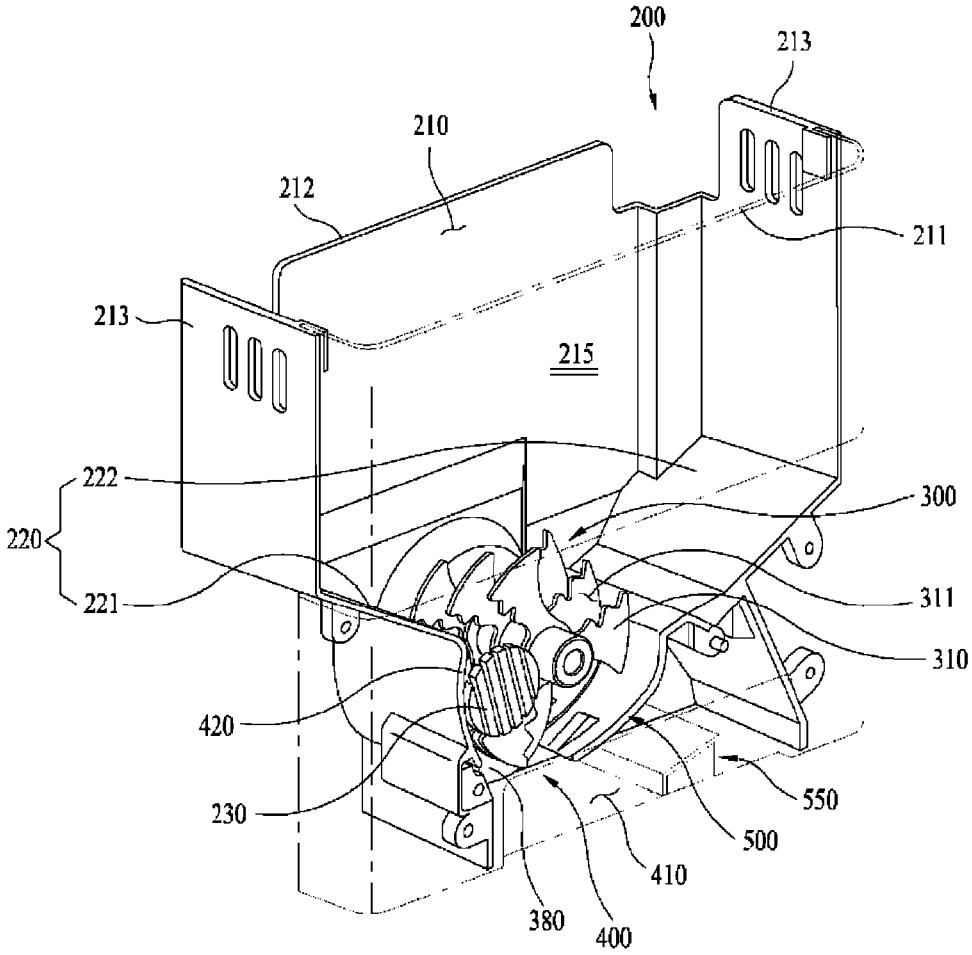
FIG. 2 is a perspective view of the ice storage bin of the refrigerator according to the embodiment of the present invention.

As shown in FIG. 2, the ice storage bin 200 includes a top opening 210, a front wall 211, a rear wall 212, and side walls 213.

The ice storage bin 200 further includes guide slopes 220 which could support ice stored in the ice storage bin 200 and, in addition, provides a path for the stored ice such that the stored ice slides downward by gravity.

The front wall 211, the rear wall 212, and the side walls 213, together with the guide slopes 220 define an ice storage space 215 to store ice.

The guide slopes 220, which numbers two in this embodiment, are spaced apart from each other. In other embodiments, one guide slope may be provided or more than two guide slopes may be provided. The respective guide slopes 220 are inclined downward toward the center of the ice storage bin 200. However, the guide slopes could be designed to provide a path anywhere towards any part of the bottom of the ice storage bin 200 in order to achieve a desired result.

The guide slopes 220 include a first guide slope 221 and a second guide slope 222. The slope angles of the first guide slope 221 and the second guide slope 222 may be similar or they may be different. For example, the first slope 221 may have a steeper angle than the second slope, or the second slope may have a steeper angle than the first slope.

An ice discharge member 300 is provided between the first guide slope 221 and the second guide slope 222 to discharge ice stored in the ice storage bin 200 out of the ice storage bin 200.

That is, the first guide slope 221 and the second guide slope 222 are located at opposite sides of the ice discharge member 300.

Preferably, the ice discharge member 300 may include at least two rotary blades 310 each having ice receiving parts 311 to receive ice. However, it is conceivable that one blade may be used in the discharge member 300.

The ice in the ice storage bin 200 that makes contact with either the first guide slope 221 or the second guide slope 222 is urged towards the ice discharge member 300 by gravity. When the ice discharge member 300 is operational, the ice is dispensed out of the refrigerator by the operation of the ice discharge member 300.

Between the first guide slope 221 and the second guide slope 222, a discharge unit 400 is provided to which the ice discharge member 300 is rotatably mounted and, in addition, the discharge unit 400 has a discharge port 410 through which ice is finally discharged outside.

The ice discharge member 300 is mounted to the discharge unit 400 such that the ice discharge member 300 can rotate in a forward direction or in a reverse direction (or in alternating directions).

At one side of the lower part of the ice discharge member 300, i.e., at one side of the discharge unit 400, are stationary blades 380 that, in cooperation with the rotary blades 310, crush ice into crushed ice when the ice discharge member 300 is rotated in a first rotational direction.

In this embodiment, the number of the stationary blades 380 is at least two. As the rotary blades 310 pass through spaces defined between the stationary blades 380, any ice that is caught between the stationary blades 380 and the rotary blades 310 is crushed into crushed ice.

On the other hand, an opening and closing member 500 selectively connects the discharge port 410 with the storage space 215 in such a manner that the storage space 215 can communicate with the discharge port 410 when the blades of the ice discharge member 300 rotate in a second rotational direction which is opposite to the first rotational direction, to dispense whole ice.

When the rotary blades 310 of the ice discharge member 300 rotate in a second direction, ice captured by ice receiving parts provided at the rotary blades 310 pushes against the opening and closing member 500 when the ice makes contact with the opening and closing member 500.

One end of the pushed opening and closing member 500 is hingedly connected to an end of the second guide slope 222. Ice making contact with the opening and closing member 500 causes a space between the opening and closing member 500 and the rotary blades 310 to widen, resulting in the ice being discharged to the discharge port 410 through the widened space. The ice is discharged as whole ice and reaches a dispenser (not shown).

Below the opening and closing member 500, an operation restriction unit 550 is provided to restrict an operation range of the opening and closing member 500 in order to prevent ice from being excessively discharged to the discharge port 410.

To summarize above, when the ice discharge member 300 is rotated in the first rotational direction, ice caught between the rotary blades 310 and the stationary blades 380 is crushed into crushed ice. As a result, the ice is discharged to the discharge port 410 as crushed ice.

On the other hand, when the ice discharge member 300 is rotated in the second rotational direction, ice caught by the rotary blades 310 pushes the opening and closing member 500 to open between the rotary blades 310 and the opening and closing member 500. As a result, the ice is discharged to the discharge port as whole ice.

At a region where the stationary blades 380 are mounted, the discharge unit 400 has a wall formed in a shape that contours a rotation track of the rotary blades 310.

Such a wall of the discharge unit 400 is shown a discharge guide wall 420. The discharge guide wall 420 may be rounded to have a curvature contouring the rotation track of the rotary blades 310.

Due to the rounded nature of the discharge guide wall 420, crushed ice is prevented from remaining in the discharge unit 400 and slips from the discharged guide wall 420 to be entirely discharged outside.

At the rear of the front wall 211 of the ice storage bin 200, an ice catching prevention part 230 protrudes toward the rotary blades 310 to prevent ice from being caught between the rotary blades 310 and the front wall 211 of the ice storage bin 200.

Figure 3:
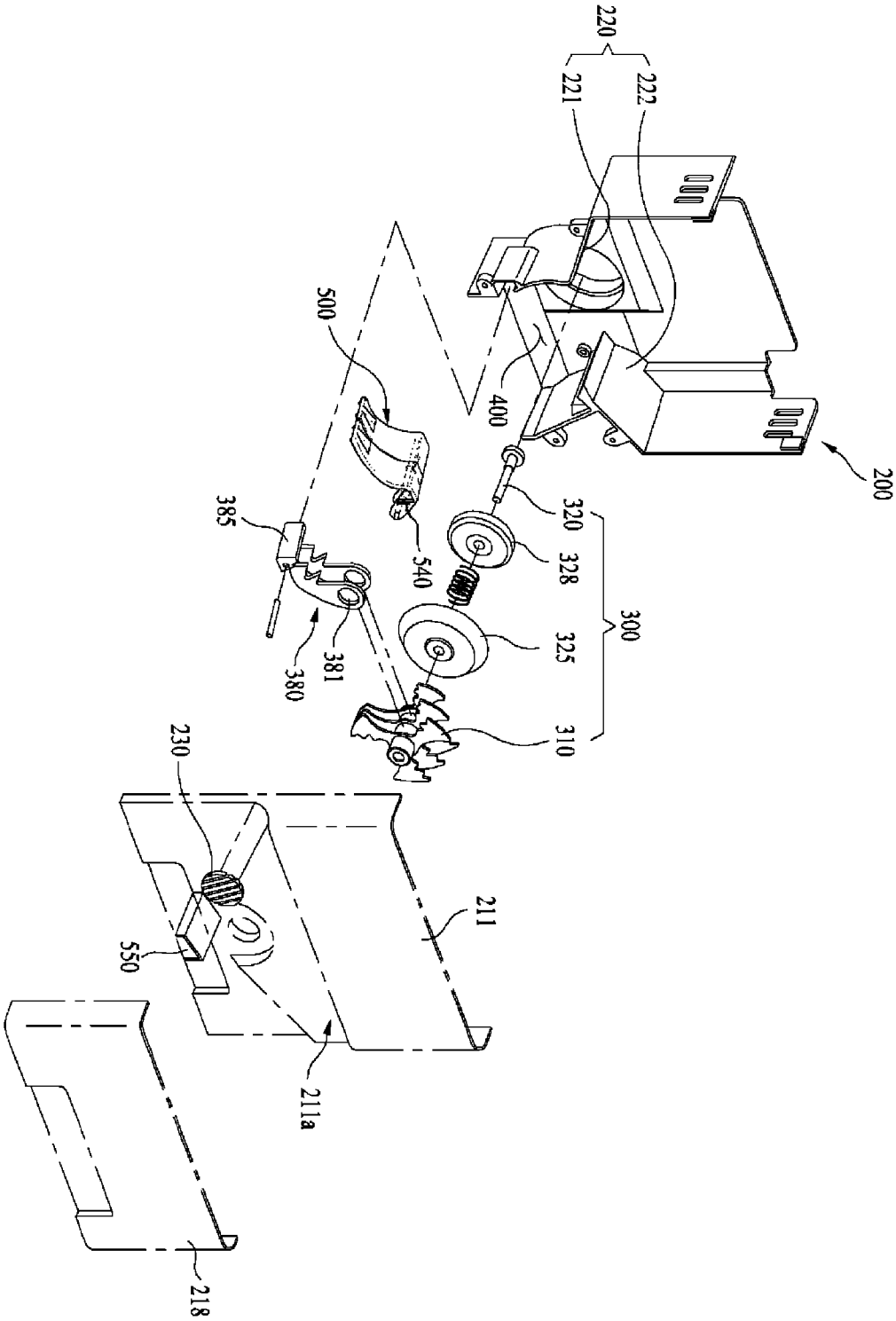
FIG. 3 is an exploded perspective view of the ice storage bin of the refrigerator according to the embodiment of the present invention.

As shown in FIG. 3, the ice discharge member 300 includes a rotary shaft 320 to which the plurality of rotary blades 310 are fixedly mounted. In this embodiment, the rotary shaft 320 extends through a space plate 325 provided behind the rotary blades 310 and a connection plate 328 connected to the drive motor 201 (See FIG. 1). The space plate 325 aids in the spacing of the rotary blades 310 and/or prevents ice from slipping through a space formed between the rotary blades 310 and the rear wall 212, for example. The space plate 325, however, may be eliminated if proper spacing between the rotary blades 310 can be maintained in order to crush ice and/or the space formed between the rotary blades 325 and the rear wall 212 can be maintained such that ice will not slip through that space. The space plate 325 may be in co-rotation with the rotary shaft 320 or be fixed in place.

The rotary blades 310 are spaced apart from each other. The rotary blades 310 are fixedly mounted to the rotary shaft 320 such that the rotary blades 310 rotates with the rotary shaft 320.

As previously described, there are a plurality of stationary blades 380. One end of each of the stationary blades 380 is mounted to the rotary shaft 320.

A through-hole 381 is formed at one end of each of the stationary blades 380 through which the rotary shaft 320 is inserted. However, the through-hole 381 may have a greater diameter than the rotary shaft 320 such that the stationary blades 380 are not moved even though the rotary shaft 320 is rotating.

Also, one end of each of the stationary blades 380 may be disposed between two adjacent rotary blades 310.

The other end of each of the stationary blades 380 may be fixed to one side wall of the discharge unit 400.

To this end, the other end of each of the stationary blades 380 is connected to a fixing member 385, and the fixing member 385 is inserted into one side wall of the discharge unit 400, to fix the stationary blades 380 to the one side wall in a manner such that the stationary blades 380 do not move.

Meanwhile, a single opening and closing member 500 is provided. However, two or more opening and closing members 500 may be provided to achieve a desired result. The opening and closing member 500 is disposed beside the stationary blades 380.

The opening and closing member 500 is attached to the discharge unit 400 by a hinge such that the opening and closing member 500 moves about the hinge from the discharge unit 400. The opening and closing member 500 may be supported by an elastic member 540 such as a spring. Alternatively, the opening and closing member 500 may be formed of an elastic material, and thereby the hinge may not be required.

As a result, the opening and closing member 500 returns to its original position when the pressure asserted by the ice on the opening and closing member 500 is released after the ice has traveled to the end of the opening and closing member 500 and slipped out of the end of the opening and closing member 500.

After the ice discharge member 300, the stationary blades 380, and the opening and closing member 500 are mounted to the ice storage bin 200, a front plate 211*a* forming the front wall 211 of the ice storage bin 200 is mounted to the ice storage bin 200.

To the lower part of the front of the front plate 211*a*, a cover member 218 may be mounted to cover the opening and closing member 500 or the stationary blades 380 such that the opening and closing member 500 or the stationary blades 380 are not exposed to the outside environment.

Figure 4:
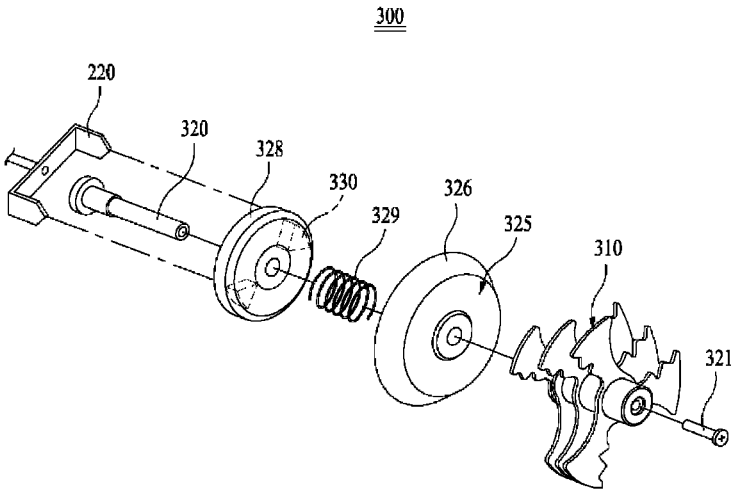
FIG. 4 is an exploded perspective view showing an ice discharge member of the refrigerator according to the embodiment of the present invention.

As shown in FIG. 4, the ice discharge member 300 according to this embodiment includes the plurality of rotary blades 310 fixedly mounted to the rotary shaft 320, the space plate 325, and the connection plate 328.

Between the space plate 325 and the connection plate 328, an elastic member 329, in a form of a coil spring, may be mounted to elastically support the connection plate 328.

The rotary blades 310, the space plate 325, the connection plate 328, and the elastic member 329 are prevented from being separated from the rotary shaft 320 by an insertion member 321 that is inserted into the front end of the rotary shaft 320 such that the rotary blades 310, the space plate 325, the connection plate 328, and the elastic member 329 are coupled to the rotary shaft 320.

At a drive shaft of the drive motor 201 (See FIG. 1), a hook member 202 is provided to which the connection member 328 is detachably connected. The connection plate 328 has a catching protrusion 330 by which the hook member 202 catches to the connection plate 328.

When a user mounts the ice storage bin 200 to the door 10 (See FIG. 1), the catching protrusion 330 may overlap with the hook member 202, such that the hook member 202 may not catch the catching protrusion 330. In this case, a driving force of the drive motor 201 (See FIG. 1) may not be transmitted to the ice discharge member 300 even though the drive motor 201 is operational.

To ensure that the driving force of the drive motor 201 gets transmitted to the ice discharge member 300, the connection plate 328 first moves toward the space plate 325 when the catching protrusion 330 overlaps with the hook member 202 such that the hook member 202 catches the catching protrusion 330.

Subsequently, when the catching protrusion 330 is released from the hook member 202 due to a release from the drive motor 201, the connection plate 328 moves backward by the elastic force of the elastic member 329.

In an alternative embodiment, the space plate 325 may be part of and fixed the rear wall 212, or the space plate 325 may be screwed to the rear wall 212. In this embodiment, the hook member 202, the connection plate 328, and the elastic member 329 may not be required. The motor 201 directly connects to the rotary shaft 320 to drive the rotary blades 310.

According to one embodiment, a slope is formed at a rim of the space plate 325 such that ice may slide from the rim of the space plate 325 to the rotary blades 310.

The plurality of rotary blades 310 are spaced apart from each other. The spaced distance between the neighboring rotary blades 310 is usually less than the size of the ice.

Figure 5:
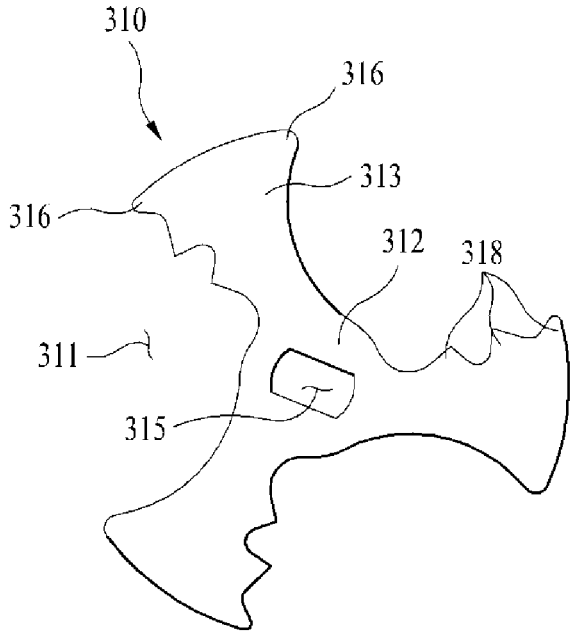
FIG. 5 is a front view showing a rotary blade of the refrigerator according to the embodiment of the present invention.

As shown in FIG. 5, each of the rotary blades 310 includes a central part 312 through which the rotary shaft extends and extensions 313 radially extend from the central part 312.

The central part 312 is provided with a slot hole type through-hole 315 through which the rotary shaft 320 extends such that the rotational motion of the rotary shaft 320 is transmitted to the central part 312.

The plurality of extensions 313 are spaced apart from each other, and ice receiving parts 311 to receive ice are provided between the neighboring extensions 313.

Each of the extensions 313 generally has a width that increases when traveling from the inside end thereof to the outside end thereof. Also, catching protrusions 316 to prevent ice received in the corresponding ice receiving part 311 from being separated from the corresponding ice receiving part 311 or rolling over the corresponding ice receiving part 311 are formed at opposite sides of the outside end of each of the extensions 313.

When the rotary blades 310 rotate with ice received in the ice receiving part 311, ice located at the outside ends of the extensions 313 is caught by the catching protrusions 316, such that the ice moves in the rotational direction of the rotary blades 310.

At one side of each of the extensions 313, a saw-toothed crushing part 318 is provided to crush ice in cooperation with the stationary blades 380.

The other side of each of the extensions 313, i.e., the side of each of the extensions 313 opposite to the crushing part 318, is smooth such that ice can move with the rotary blades 310 without being crushed.

Therefore, the crushing part 318 is located opposite to the smooth side in each of the ice receiving part 311.

Figure 6:
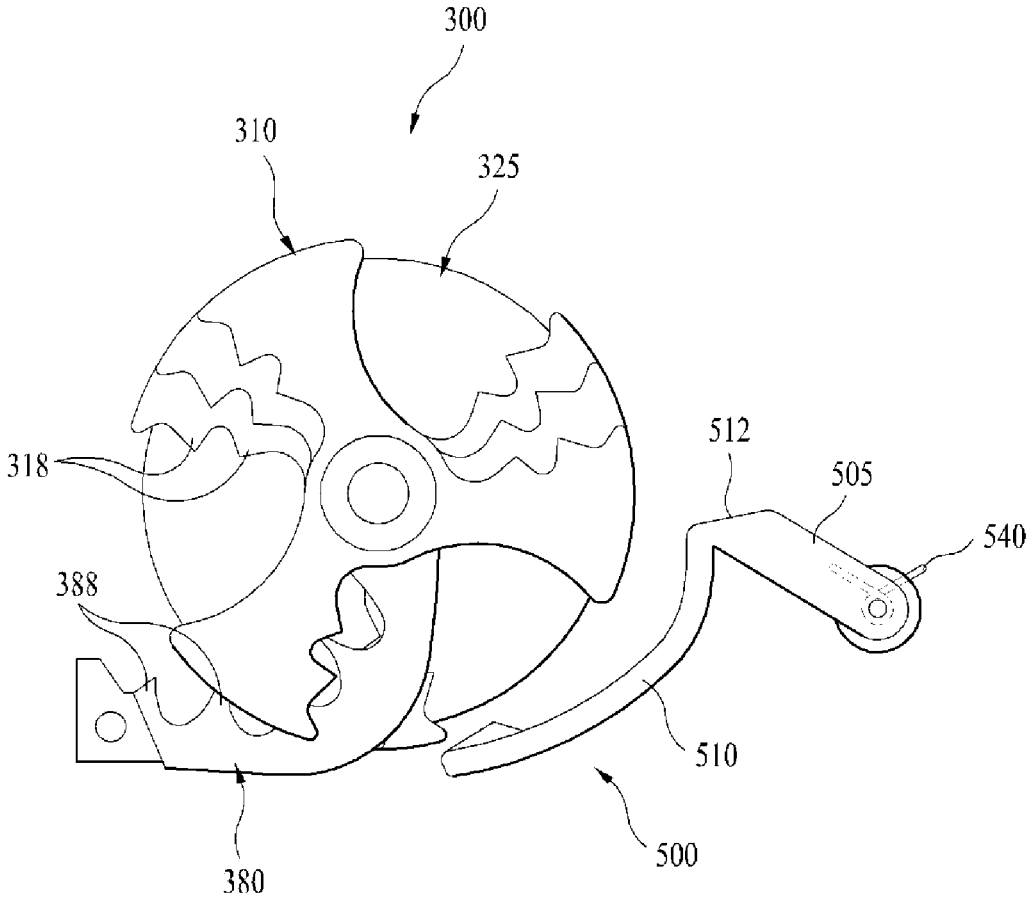
FIG. 6 is a front view showing the ice discharge member, a fixing blade, and an opening and closing member of the refrigerator according to the embodiment of the present invention.

When the rotary blades 310 are fixedly mounted to the rotary shaft 320, as shown in FIG. 6, the rotary blades 310 may not aligned with each other but may be offset to some extent from each other.

That is, when viewed from in front, the rotary blades 310 may not fully overlap but may be offset by a predetermined angle.

This may enhance the crushing of ice because when the rotary blades 310 rotate toward the stationary blades 380 to crush ice, pressure applied to the ice may diffuse and weaken over the plural rotary blades 310 in a structure in which the rotary blades 310 fully overlap with each other, with the result that crushing the ice may be difficult.

On the other hand, when the rotary blades 310 are offset to some extent as described above, ice is crushed by contact between the ice and the crushing part 318 of the first rotary blade 310. After that, the ice comes into contact with the crushing part 318 of the second rotary blade 310 and then the crushing part 318 of the third rotary blade 310 at regular intervals.

Consequently, rotational force from the ice discharge member 300 is concentrated on the respective crushing parts 318, with the result that ice crushing efficiency is considerably improved.

A saw-toothed crushing part 388 to crush ice may be provided at each of the stationary blades 380. Each of the stationary blades 380 may be formed in an "L" shape. However, the shape of each of the stationary blades 380 is not particularly restricted.

The opening and closing member 500 is provided beside the stationary blades 380. The opening and closing member 500 includes a hinge type rotation part 505 hingedly mounted to the ice storage bin 200. The hinge type rotation part 505 is provided with an elastic member 540 formed in the shape of a torsion spring to elastically support the opening and closing member 500.

One end of the elastic member 540 is fixed to the ice storage bin 200, and the other end of the elastic member 540 is mounted to one side of the opening and closing member 500 to elastically support the opening and closing member 500.

When the pressure applied to the opening and closing member 500 from the ice is released after the ice has slipped away from the opening and closing member 500, the tensed elastic member 540 returns to its original position thereby closing the opening and closing member 500.

The opening and closing member 500 includes a first guide way 510 provided in the vicinity of the rotation track of each of the rotary blades 310 and a second guide way 512 connected to the first guide way 510 and the hinge type rotation part 505.

The first guide way 510 and the second guide way 512 are disposed in an inclined manner. The second guide way 512 may be continuous with the second guide slope 222 (See FIG. 2).

The first guide way 510 may be circular in shape that contours the rotation track of each of the rotary blades 310 to guide the discharge of ice.

Figure 7:
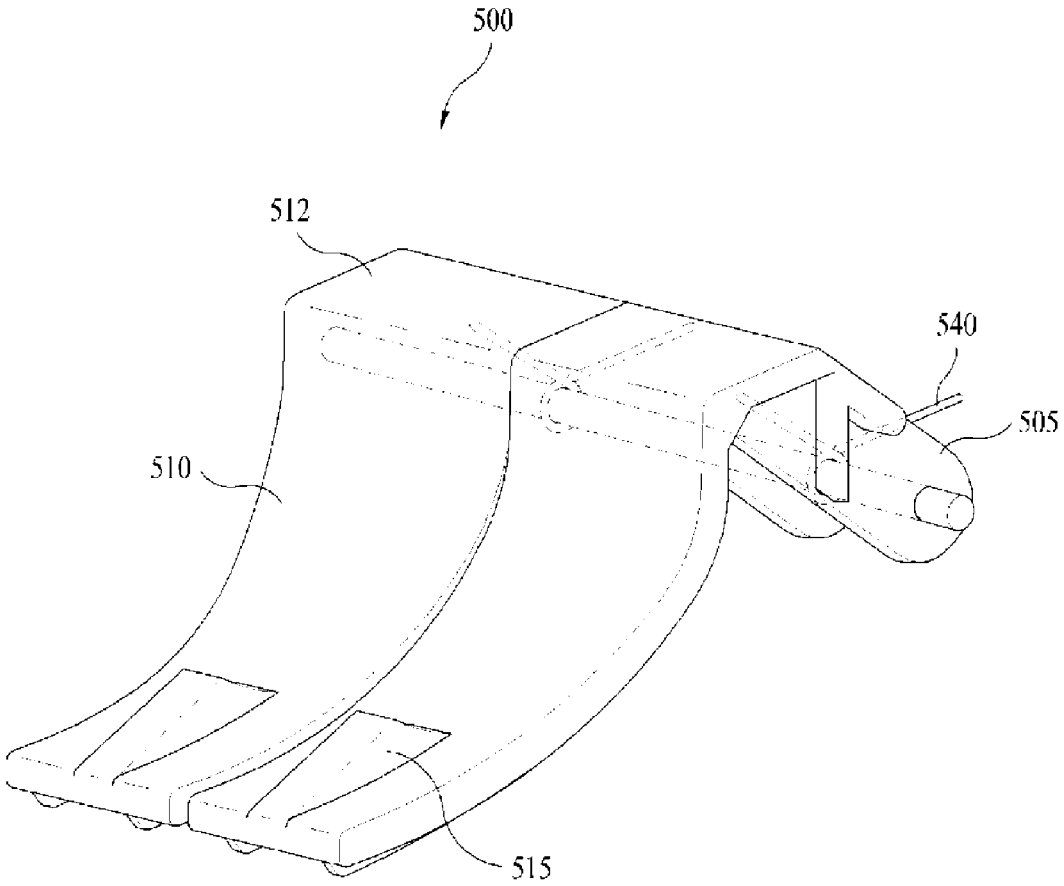
FIG. 7 is a perspective view of the opening and closing member of the refrigerator according to the embodiment of the present invention.

As shown in FIG. 7, a plurality of opening and closing members 500 may be provided. The respective opening and closing members 500 are independently operated. Therefore, the operation of one of the opening and closing members 500 does not affect the operation of the other opening and closing members 500.

The reason that the plurality of opening and closing members 500 are provided, and the respective opening and closing members 500 are independently operated is as follows.

If only one opening and closing member 500 is provided, for example, some ice cubes coming through the guide way of the opening and closing member 500 may be remain on a portion of the guide way without being discharged, such that the other ice cubes may pass downward through a gap formed at the other portion in which no ice cubes are present resulting in an unintended discharge of ice cubes.

In the structure in which the plurality of opening and closing members 500 are provided, even though some ice cubes are caught by one of the opening and closing members 500, with the result that the one of the opening and closing members 500 remain open, the other opening and closing members 500 by which no ice cubes are caught remain closed, thereby preventing the other ice cubes from being unintentionally discharged.

To this end, the elastic member 540 may be provided for each of the opening and closing members 500.

Each of the opening and closing members 500 is provided with a catching protrusion 515 to prevent ice caught between each of the opening and closing members 500 and the rotary blades 310 from being discharged outside when each of the opening and closing members 500 is closed.

The catching protrusion 515 may be provided on a top surface of the first guide way 510.

Figure 8:
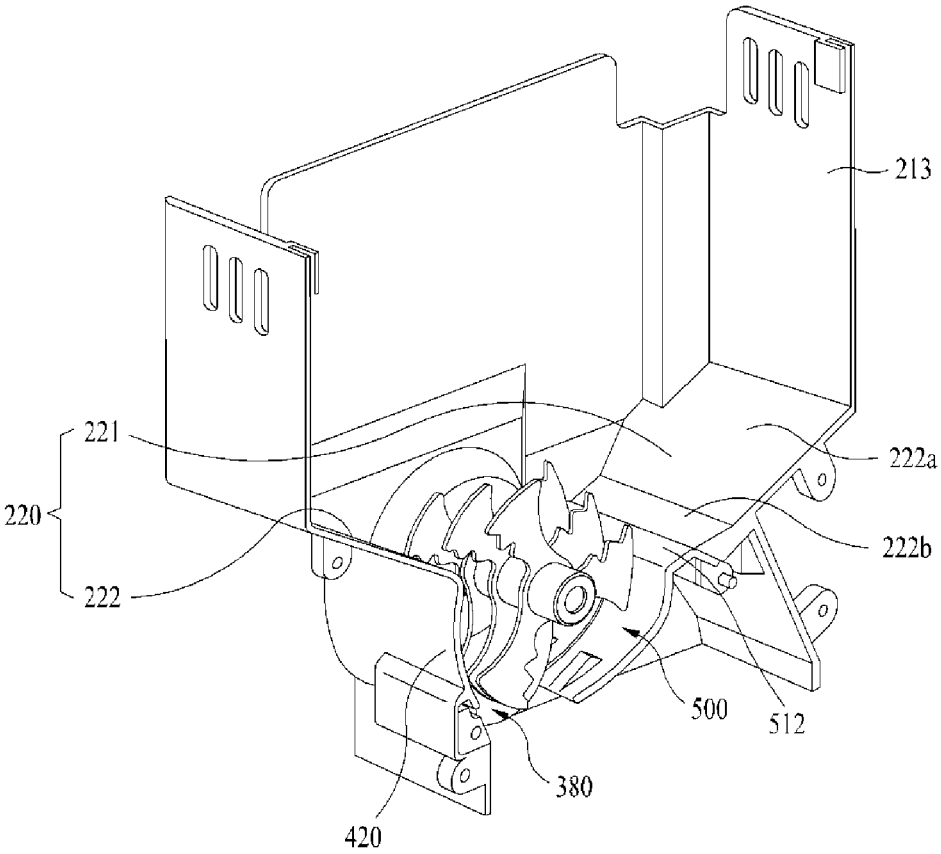
FIG. 8 is an interior perspective view of the ice storage bin of the refrigerator according to the embodiment of the present invention.

As shown in FIG. 8, the first guide slope 221 is provided in the vicinity of the stationary blades 380, and the second guide slope 222 is provided in the vicinity of the opening and closing members 500.

At one side of the discharge unit 400, a discharge guide wall 420 is provided that extends downward towards the discharge port 410.

The discharge guide wall 420 may be provided above a region where one end of each of the stationary blades 380 is fixed. The discharge guide wall 420 guides the discharge of crushed ice in order to prevent the crushed ice from remaining in the ice storage bin 200.

The discharge guide wall 420 may be formed in the shape of a round wall depressed outward such that the discharge guide wall 420 has a predetermined curvature.

The second guide slope 222 may be divided into two sloped parts such that the speed of ice moving to the ice discharge member 300 along the second guide slope 222 may be adjusted in order to prevent the ice from breaking apart.

To this end, the second guide slope 222 includes an outside guide slope 222*a* connected to a corresponding one of the side walls 213 of the ice storage bin 200 and an inside guide slope 222*b* connected to the outside guide slope 222*a*, and the inside guide slope 222*b* is disposed in the vicinity of the ice discharge member 300.

The inside guide slope 222*b* has a lower gradient than the outside guide slope 222*a* (see FIG. 9) such that the speed of ice sliding downward along the guide slope 222*a* is reduced when the ice encounters the guide slope 222*b*.

The second guide way 512 of each of the opening and closing members 500 is disposed at one end of the inside guide slope 222*b* such that the second guide way 512 is continuous with the inside guide slope 222*b*.

When the discharge port 410 is closed by the opening and closing members 500, the speed of ice is reduced since the slope of the second guide way 512 is similar to the slope of the guide slope 222*b*.

When the discharge port 410 is opened by the opening and closing members 500, the second guide way 512 is moved downward forming a steeper slope that guides ice toward the discharge port 410 faster.

Figure 9:
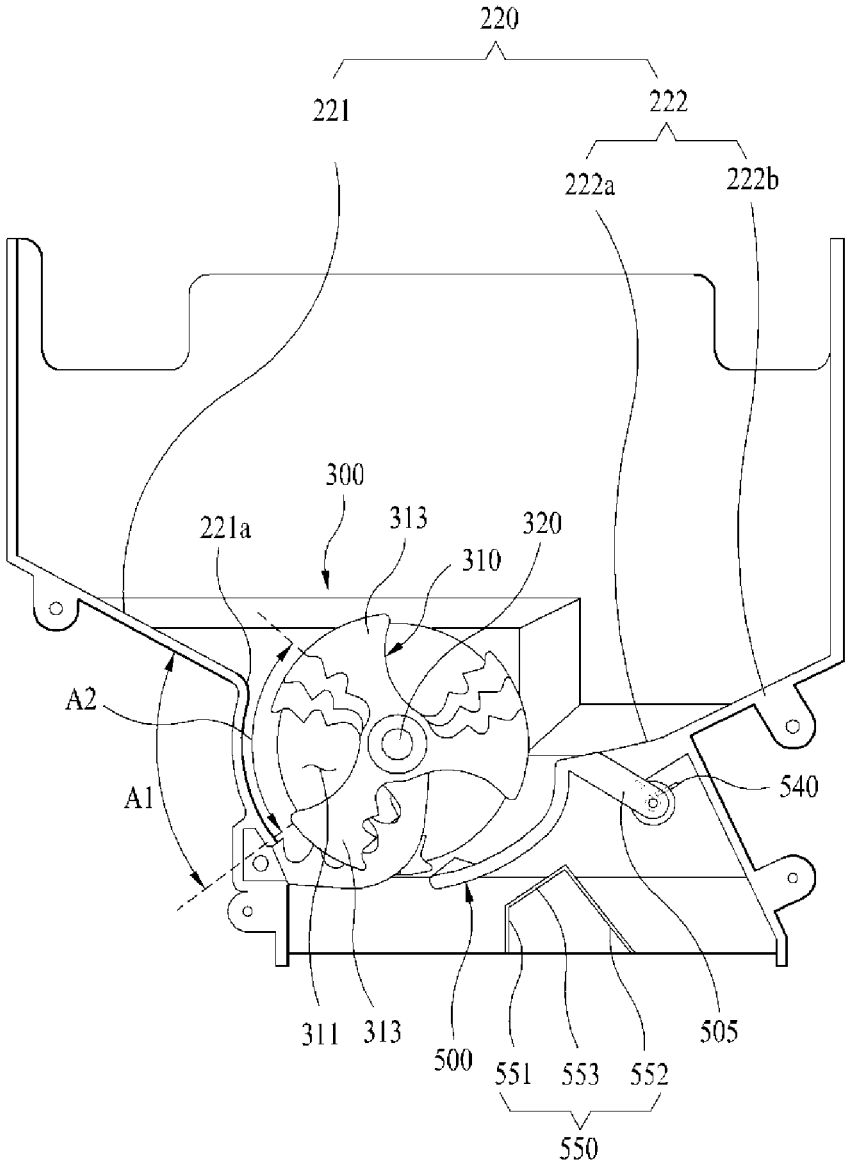
FIG. 9 is an interior front view of the ice storage bin of the refrigerator according to the embodiment of the present invention.

As shown in FIG. 9, the first guide slope 221 may have a higher slope end point 221*a* than the rotary shaft 320 of the ice discharge member 300. However, some embodiment may have the rotary shaft 320 be level with the end point of the first guide slope. It may be desirable that the rotary shaft 320 may be level with an end point of the second guide slope 222 or higher than the end point of the second guide slope 222. One aspect of the position of the rotary shaft with respect to the guide slopes may be the ease that the rotary blades can move the ice on the guide slopes.

In this structure, some ice crushed at a region where the stationary blades 380 are disposed is prevented from moving upward along the first guide slope 221.

The curvature of the discharge guide wall 420 to prevent some crushed ice from remaining in the ice storage bin 200 may be equivalent to the curvature corresponding to the rotation track of each of the rotary blades 310. An arc A1 forming the discharge guide wall 420 may have a length corresponding to the distance between the neighboring extensions 313 of each of the rotary blades 310, i.e., the maximum width A2 of each of the ice receiving parts 311.

Ice is crushed in each of the ice receiving parts 311. In the above structure, therefore, ice crushed in each of the ice receiving parts 311 collides with the discharge guide wall 420, with the result that the crushed ice drops downward.

On the other hand, the second guide slope 222 may have a lower gradient than the first guide slope 221 such that ice remains as whole ice.

The gradient of the inside guide slope 222*b* of the second guide slope 222 may be substantially equal to that of the second guide way 512 of each of the opening and closing members 500 such that the inside guide slope 222*b* of the second guide slope 222 is continuous with the second guide way 512 of each of the opening and closing members 500. Also, the hinge type rotation part 505 of each of the opening and closing members 500 may be located lower than the rotary shaft 320 of the ice discharge member 300 such that the gradient of the second guide slope 222 is lower than that of the first guide slope 221.

That is, if the hinge type rotation part 505 of each of the opening and closing members 500 is located higher than the rotary shaft 320 of the ice discharge member 300, the second guide slope 222 is much steeper, which is contrary to reducing the speed of ice.

In consideration of a structural property in which the hinge type rotation part 505 of each of the opening and closing members 500 is located below the second guide slope 222, therefore, the hinge type rotation part 505 of each of the opening and closing members 500 may be located lower than the rotary shaft 320 of the ice discharge member 300.

If the opening angle of the each of the opening and closing members 500 is too large, an excessive amount of ice may be discharged. For this reason, it is desirable to restrict the opening angle of the each of the opening and closing members 500.

Therefore, the operation restriction unit 550 is provided below the opening and closing members 500 to restrict the opening angle of each of the opening and closing members 500.

The operation restriction unit 550 includes a first vertical rib 551, a second rib 552 spaced apart from the first rib 551, the second rib 552 being higher than the first rib 551, and an inclined contact part 553 to interconnect the upper end of the first rib 551 and the upper end of the second rib 552. The contact part 553 is configured to contact each of the opening and closing members 500.

That is, each of the opening and closing members 500 comes into contact with the contact part 553, with the result that the opening degree of the each of the opening and closing members 500 is restricted.

As previously described in detail, the plurality of opening and closing members 500 may be provided, and therefore, depending on the shape of the operation restriction unit 550, the respective opening and closing members 500 may have different maximum opening degrees.

This reflects that the rotary blades 310 are mutually offsetted to some extent, and therefore, the ice receiving parts 311 of one of the rotary blades 310 are offset with respect to the ice receiving parts 311 of the other the rotary blades 310.

Figure 10:
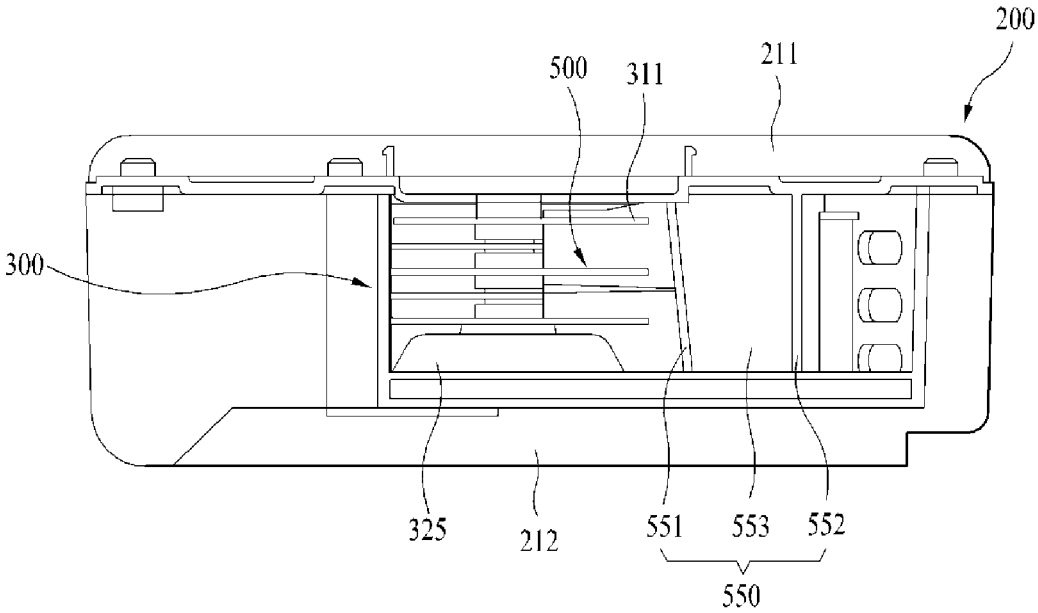
FIG. 10 is a bottom plan view of the ice storage bin of the refrigerator according to the embodiment of the present invention.

The lower part of the operation restriction unit 550 is shown in FIG. 10.

In this drawing, the lower side of the ice storage bin 200 is the rear of the ice storage bin 200, and the upper side of the ice storage bin 200 is the front of the ice storage bin 200.

As shown in FIG. 10, two opening and closing members 500 are provided such that the opening and closing members 500 are independently operated.

The first rib 551 is disposed at an angle from the rear to the front of the ice storage bin 200 such that the first rib 551 is directed inward towards the center of the ice storage bin 200.

Consequently, the ice discharge area is gradually increased from the front to the rear of the ice storage bin 200.

According to one embodiment, the opening and closing member 500 disposed at the front of the ice storage bin 200 has a lower rotational angle than the other opening and closing member 500 disposed at the rear of the ice storage bin 200.

Such construction of the first rib 551 reflects that, as previously described in detail, the plurality of rotary blades 310 do not fully overlap but are mutually offsetted to some extent.

Figure 11:
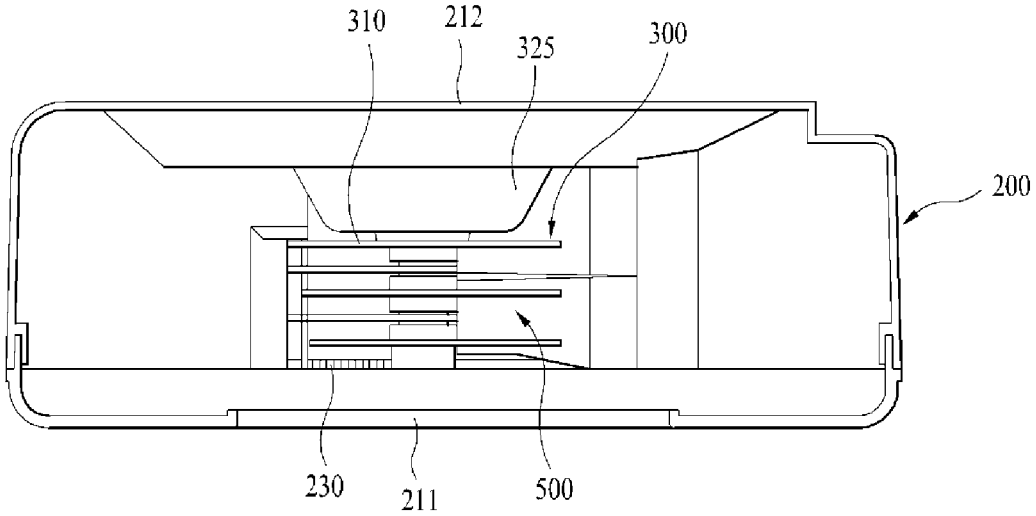
FIG. 11 is a top plan view of the ice storage bin of the refrigerator according to the embodiment of the present invention.

FIG. 11 is a top plan view of the ice storage bin 200.

The ice catching prevention part 230 is provided inside the front wall 211 of the ice storage bin 200.

The ice catching prevention part 230 protrudes or extends inward from inside the front wall 211 of the ice storage bin 200. As a result, the ice catching prevention part 230 occupies a space between the frontmost one of the rotary blades 310 and the front wall 211 of the ice storage bin 200.

The ice catching prevention part 230 may be provided above a region where crushed ice is discharged.

At a region where cube ice is discharged, a space between the front wall 211 of the ice storage bin 200 and a corresponding one of the rotary blades 310 is much smaller than a cube of ice, with the result that cube ice is prevented from being caught between the front wall 211 of the ice storage bin 200 and a corresponding one of the rotary blades 310.

For crushed ice, on the other hand, the size of the crushed ice may be equal to that of the space between the front wall 211 of the ice storage bin 200 and a corresponding one of the rotary blades 310, with the result that the crushed ice may be caught between the front wall 211 of the ice storage bin 200 and a corresponding one of the rotary blades 310, which may interfere with the rotational operation of the rotary blades 310.

Such interference may be prevented by the provision of the ice catching prevention part 230.

Hereinafter, the operation of the refrigerator according to an embodiment of the present invention will be described in detail with reference to the accompanying drawings.

Figure 12:
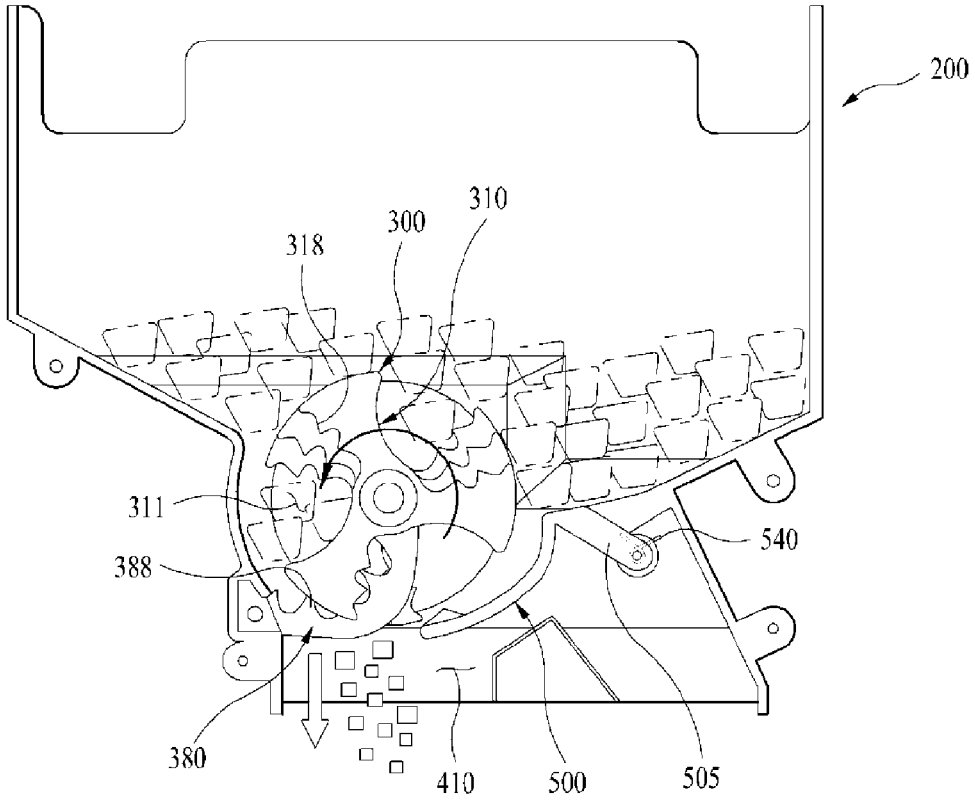
FIG. 12 is a front view showing crushed ice being discharged from the refrigerator according to the embodiment of the present invention.

When a user inputs a command to dispense crushed ice, as shown in FIG. 12, the ice discharge member 300 rotates in a first rotational direction, in this instance, counterclockwise.

As a result, the crushing parts 318 of the rotary blades 310 gradually approach the crushing parts 388 of the stationary blades 380.

Consequently, ice received in the ice receiving parts of the rotary blades 310 is placed on the stationary blades 380 by the rotation of the rotary blades 310.

When the rotary blades 310 rotate further, ice caught between the crushing parts 318 of the rotary blades 310 and the crushing parts 388 of the stationary blades 380 is crushed into crushed ice. The crushed ice then drops toward the discharge port 410 and is discharged to the outside.

During the discharge of the crushed ice, the opening and closing members 500 remain closed such that ice gathered at the opening and closing members 500 is prevented from being discharged downward.

Figure 13:
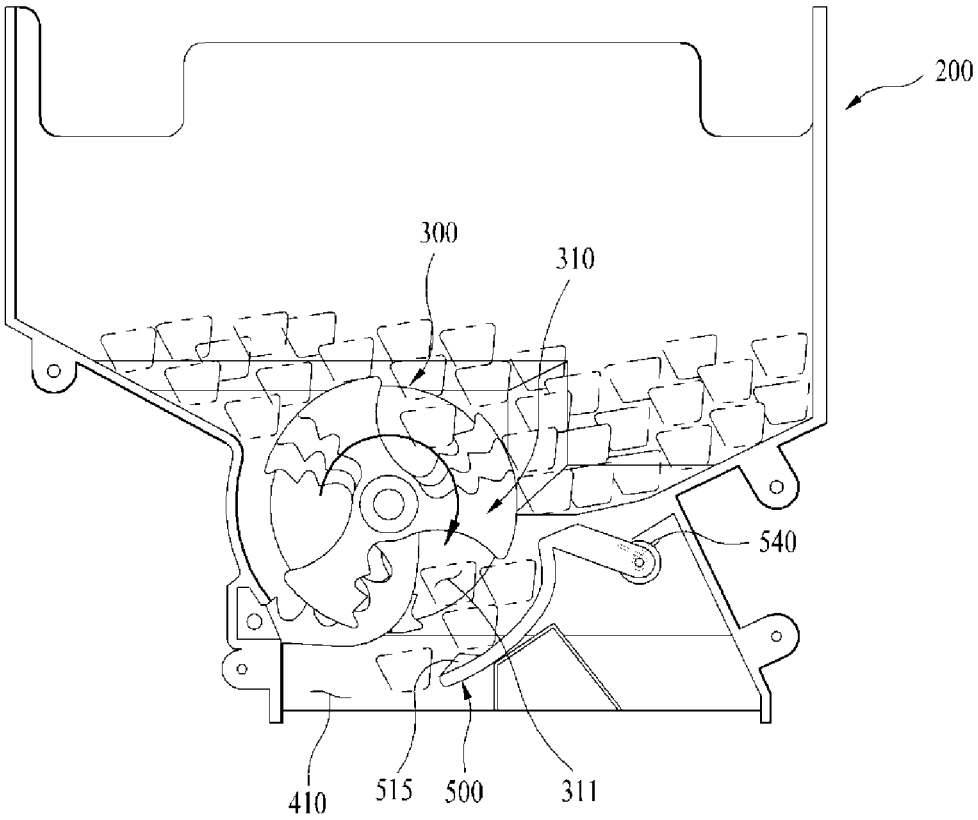
FIG. 13 is a front view showing cube ice being discharged from the refrigerator according to the embodiment of the present invention.

On the other hand, when a user inputs a command to discharge ice such that ice is discharged as whole ice, as shown in FIG. 13, the ice discharge member 300 rotates in the second rotational direction, in this instance, clockwise direction.

As a result, ice received in the ice receiving parts of the rotary blades 310 moves toward the opening and closing members 500 by the rotation of the rotary blades 310.

When the rotary blades 310 continues to rotate in this state, the extensions 311 of the rotary blades 310 push the ice placed on the opening and closing members 500.

As a result, pressure from the rotary blades 310 is applied to the opening and closing members 500 via the ice.

The opening and closing members 500 are hingedly rotated downward by the pressure from the rotary blades 310 and the ice, with the result that a space is formed between the ends of the extensions 313 of the rotary blades 310 and the corresponding ends of the opening and closing members 500, and thus the ice is discharged through the space.

The opening angle of the opening and closing members 500 is not limitless. Specifically, the bottom of each of the opening and closing members 500 comes into contact with the operation restriction unit 550 that restricts the opening angle of each of the opening and closing members 500, with the result that excessive discharge of ice is prevented.

When a predetermined amount of ice is discharged, the ice discharge member 300 stops rotating, with the result that the pressure applied to the ice from the rotary blades 310 is released.

When the pressure is released, each of the opening and closing members 500 is returned to its original position by the elastic force of the elastic member 540, with the result that each of the opening and closing members 500 is restored to its original position that is located adjacent to the end of the corresponding extension 313 of each of the rotary blades 310.

Consequently, the ice is prevented from being discharged out of the discharge port 410.

Even when the ice is placed between the rotary blades 310 and the opening and closing members 500, the ice is caught by the catching protrusions 515 of the opening and closing members 500, with the result that the ice is prevented from dropping downward toward the discharge port 410.

Ice moves toward the ice discharge member by gravity. Consequently, an additional conveyance device, such as an auger, to forcibly move ice toward the ice discharge member is not necessary, and therefore, the interior structure of the refrigerator is more simplified. The inventors who conceived the ice storage bin with the ice discharge member but no auger, have shown that better performance could be achieved without the auger, which is contrary to conventional wisdom that dictates that an auger should be used to forcibly move ice to the ice discharge member. The embodiments described above provide better performance, and yet obviates the need of an auger.

Also, most of the ice moves downward vertically. Consequently, the discharge distance of the ice is reduced, and therefore, a slim refrigerator is achieved. There may be instances where two or more pieces of ice moving downward vertically from the ice maker are clumped together. Also, these clumped pieces of ice may occur during storage in the ice storage bin. These clumped pieces of ice may hinder with the operation of the rotary blades of the ice discharge member as the rotary blades are usually designed to crush or discharge one piece of ice at a time. Accordingly, it is desirable to separate these clumped pieces of ice into individual ice pieces prior to being operated on by the rotary blades of the ice discharge member.

Figure 14:
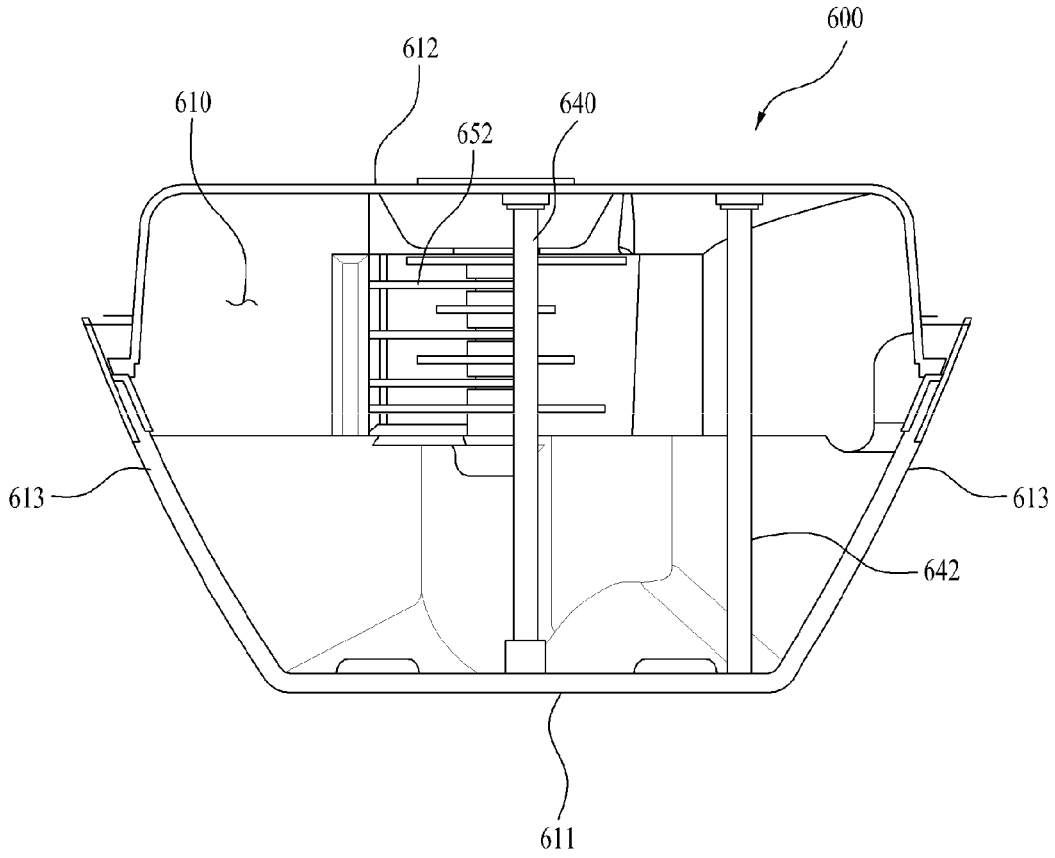
FIG. 14 is a top plan view of an ice storage bin including an ice separating device according to an embodiment of the present invention.
Figure 15:
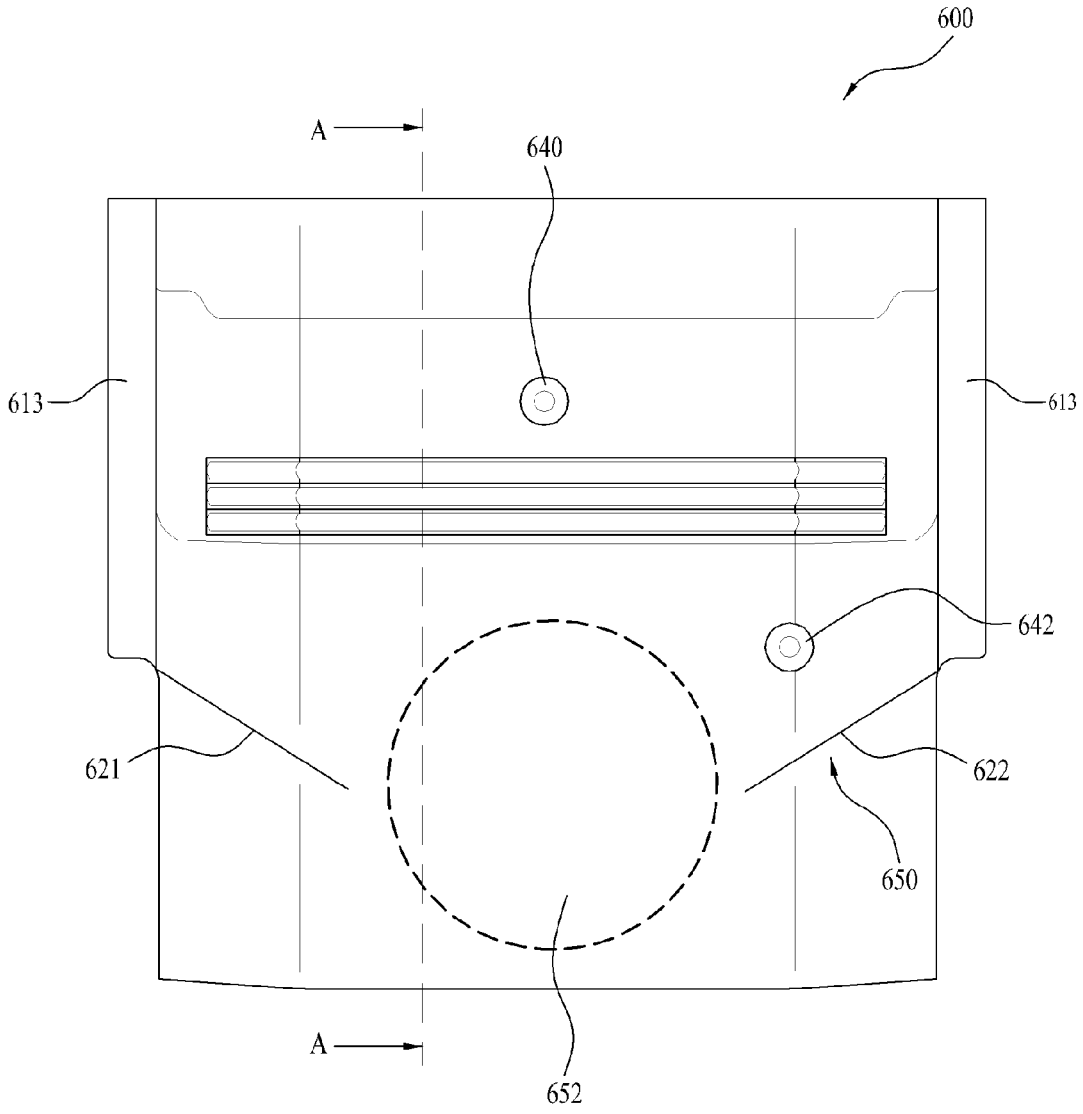
FIG. 15 is a front view of the ice storage bin of FIG. 14 according to the embodiment of the present invention.
Figure 16:
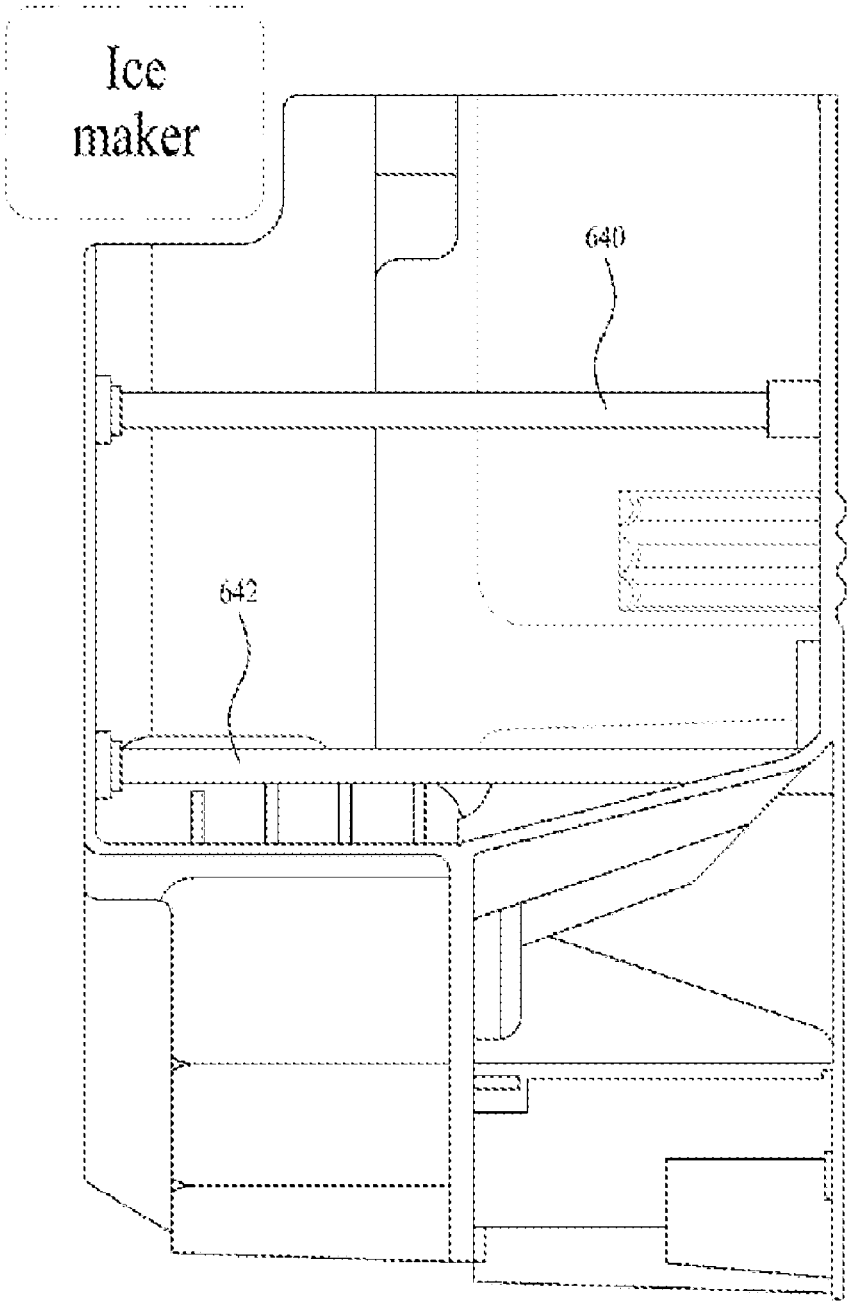
FIG. 16 is a cross-section view of the ice storage bin of FIG. 15 according to the embodiment of the present invention.

FIG. 14 is a top plan view of an ice storage bin 600 according to an embodiment; FIG. 15 is a front view of the ice storage bin 600 according to the embodiment; and FIG. 16 is a cross-section view of the ice storage bin 600 according to the embodiment. The disclosures made in FIGS. 1-13 are equally applicable to the ice storage bin 600 and parts therein, and the refrigerator including the ice storage bin, and thus will not be repeatedly described below. Referring to FIG. 14, the ice storage bin 600 includes a top opening 610, a front wall 611, a rear wall 612, and side walls 613. Referring to FIG. 15, at the bottom of the ice storage bin 600, there is an ice discharge member 650 that includes a plurality of rotary blades 652. Two guide slopes, a first guide slope 621 and a second guide slope 622, are spaced apart from each other and are disposed at an end of the side walls 613, respectively. In other embodiments, one guide slope may be provided or more than two guide slopes may be provided. The first and second guide slopes 621 and 622 are sloped toward the bottom of the ice discharge member 650 to urge pieces of ice formed by the ice maker 30 toward the plurality of blades 652.

Referring to FIGS. 14-16, an ice separating device is provided in the ice storage bin 600 between the ice maker and the ice discharge member 300. In this embodiment, the ice separating device includes a bar 640 that is installed between the front wall 611 and the rear wall 612 of the ice storage bin 600.

However, the ice separating device need not be limited to this configuration. For instance, the ice separating device may be one or more blade-shaped plates with an edge pointing towards the ice maker. The bar 640 is shown with a circular cross-section. However, the bar 640 need not be limited to this configuration. For instance, the bar 640 may have a polygon cross-section such that one or more edges of the polygon cross-section may aid in the separating of the clumped ice. Also, the bar 640 may have an elliptical cross-section. The bar 640 may be made of metal or non-metal material. In this embodiment, the material used may be zinc-coated steel or stainless steel.

The bar 640 may be positioned at an upper part of the ice bin 600 close to the ice maker. However, the bar 640 may be positioned closer to the ice discharge member 650 or the bar 640 may be positioned half-way between the ice maker and the ice discharge member 650. The positioning of the bar 640 may depend on the location where the bar 640 will most likely separate the clumped pieces of ice into two or more pieces. Another factor to consider may be the location where the clumped ice impacts the bar 640 with sufficient force so as to separate the clumped ice into two or more pieces.

In this embodiment, the bar 640 is positioned about half-way between the ice maker and the ice discharge member 650. The bar 640 is centered or close to the center of the ice storage bin 600. In another embodiment. the bar 640 may be placed on the left side of the ice storage bin 600 or on the right side of the ice storage bin 600. The positioning of the bar 640 may depend on where the ice is discharged from the ice maker. Although one bar 640 is shown in FIG. 14, other embodiments need not be limited to this configuration. For instance, in another embodiment, the bar 640 may be a plurality of bars installed in a way to cover the top opening 610 such that the clumped pieces of ice may be consistently separated into two or more pieces. A factor to consider when more than one bar is used is a space between two bars such that the separated clumped ice may pass between the two bars.

As shown in FIGS. 14-16, another bar 642 may be installed between the front wall 611 and the rear wall 612 that is lower than the bar 640. For instance, the bar 642 may be positioned in a vicinity between the plurality of blades 652 and the side wall 613 as shown in FIG. 15. In another embodiment, the bar 642 may be positioned between the plurality of blades and the other side wall 613. In yet another embodiment, two bars may be installed and positioned on either side of the plurality of blades.

Figure 17:
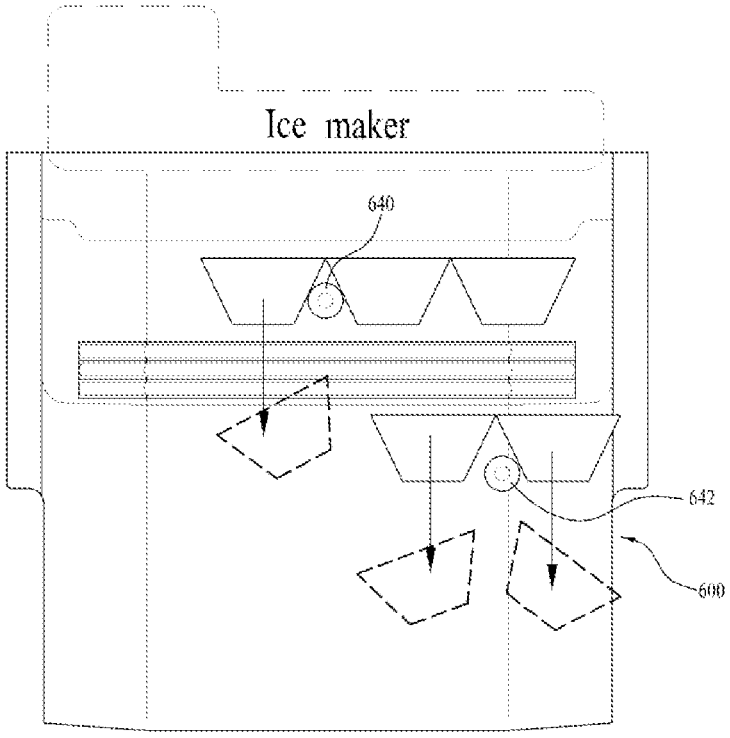
FIG. 17 shows an operation of the ice storage bin described in FIGS. 14-16 according to an embodiment of the present invention.

FIG. 17 shows an operation of the ice storage bin 600 that includes the bars 640 and 642 according to the embodiment. Referring to FIG. 17, two or more pieces of ice clumped together are discharged from the ice maker. As the clumped pieces of ice fall towards the bottom of the ice storage bin 600, the clumped pieces of ice impact with the bar 640 and separate into two or more pieces of ice. Among the separated ice pieces, if there are any clumped pieces of ice remaining, as the clumped pieces of ice continue to fall towards the bottom of the ice storage bin 600, the clumped pieces of ice encounter and impact with the bar 642 that is situated lower than the bar 640 at the ice storage bin 600. The impart further separate the clumped ice into individual ice pieces. Accordingly, due to the bars 640 and 642 installed at the ice storage bin 600, the clumped pieces of ice discharged from the ice maker are separated and fall as separate ice pieces towards the bottom of the ice storage bin 600. While, this embodiment shows two installed bars 640 and 642, more bars may be installed to ensure that the clumped pieces of ice are separated into individual ice pieces.

Figure 18:
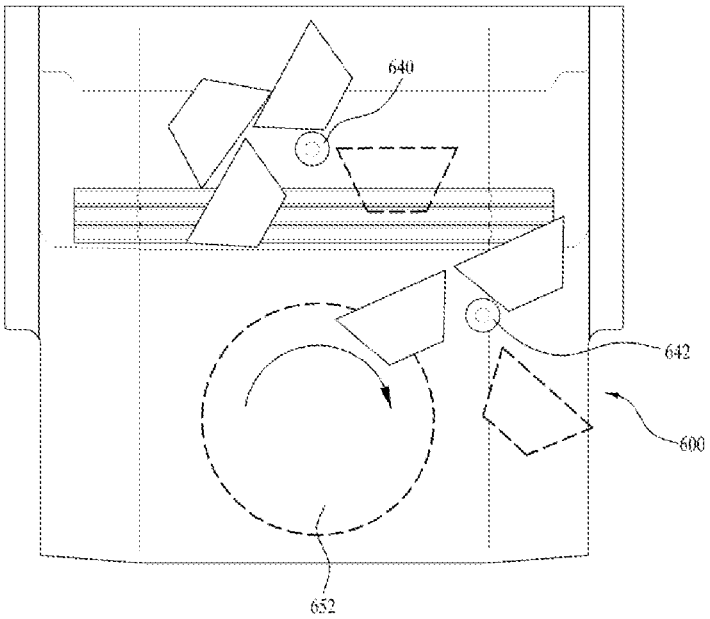
FIG. 18 shows an operation of the ice storage bin described in FIGS. 14-16 according to the another embodiment of the invention.

FIG. 18 shows an operation of the ice storage bin 600 that includes the bars 640 and 642, and the plurality of blades 652 according to the embodiment. Referring now to FIG. 18, two or more pieces of ice clumped together are discharged from the ice maker. As the clumped pieces of ice fall towards the bottom of the ice storage bin 600, the clumped ice encounter and impact with the bar 640 and separate into two or more pieces. If there are any remaining clumped pieces of ice left, as the clumped ice continue to fall towards the plurality of blades 652, a drive motor coupled to the plurality of blades 652 is energized to rotate the plurality of blades 652. For instance the drive motor may be the drive motor 201 (See FIG. 1). The manner the drive motor 201 is coupled to the plurality of blades has been described with reference to FIG. 3. The drive motor 201 may be activated by a controller, which may be located in the refrigerator, when the ice maker discharges clumped pieces of ice towards the ice storage bin. The rotating blades 652, on impact with the clumped pieces of ice, may separate the clumped pieces of ice into individual pieces of ice. The rotating ice blades 652 may cause the clumped pieces of ice to be propelled to the bar 642. As the clumped ice impact with the bar 642, the clumped pieces of ice are separated into individual ice pieces. In another operation, The drive motor 201 drives the rotating blades 652, which makes impact with pieces of ice already in the ice storage bin 600, which may be clumped pieces of ice, to separate the clumped pieces of ice into individual pieces of ice. The rotating ice blades 652 may further cause the clumped ice to be propelled to the bar 642. As the clumped ice impact with the bar 642, the clumped pieces of ice are separated into individual ice pieces.

The bar 642 may be installed such that the bar is not perpendicular to the rotary shaft connected to the plurality of blades. There may be an angle between an axis of the bar 642 and the rotary shaft connected to the plurality of blades. In one embodiment, the axis of the bar 642 and the rotary shaft are in parallel with each other.

Accordingly, installing one or more bars in the ice storage bin along the path of the falling clumped pieces of ice, along with the operation of the plurality of blades, may effectively separate the clumped pieces of ice into individual ice pieces such that the plurality of blades 352 may operate on individual ice pieces. In one embodiment, only the bar 642 is disposed in the ice storage bin. That is, the bar 640 is eliminated. The operation of this embodiment is as follows: The drive motor 201 may be activated by a controller, which may be located in the refrigerator. The drive motor 201 drives the rotating blades 652, which makes impact with pieces of ice already in the ice storage bin 600, which may be clumped pieces of ice, to separate the clumped pieces of ice into two or more pieces. The rotating ice blades 652 may further cause the clumped ice to be propelled to the bar 642. As the clumped ice impact with the bar 642, the clumped pieces of ice are separated into individual ice pieces.

Figure 19:
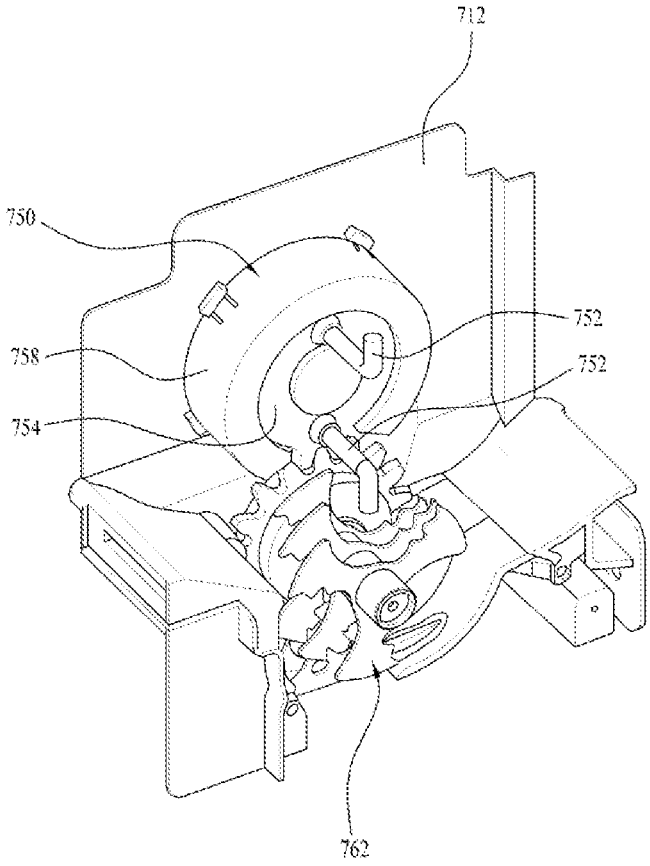
FIGS. 19 and 20 show another ice separating device according to an embodiment of the invention.
Figure 20:
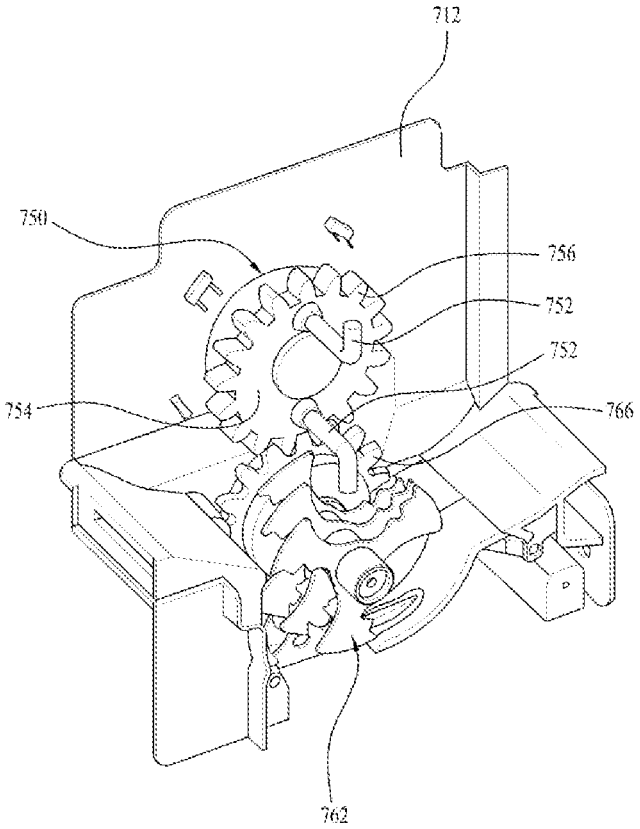

FIGS. 19 and 20 show another embodiment of an ice separating device 750 that may be used to separate clumped pieces of ice. Referring to FIG. 19, the ice separating device 750 is disposed on the rear wall 712 of the ice storage bin. In other embodiments, the ice separating device 750 may be disposed at the front wall or the side wall of the ice storage bin. The ice separating device 750 may include one or more protrusions 752 that protrude from a base 754 to which the one or more protrusions 752 are disposed. In this embodiment, the ice separating device 750 has two protrusions 752. However, the ice separating device need not be limited to this configuration. In other embodiments, the ice separation device may have one protrusion or more than two protrusions. In this embodiment, the protrusions 752 are in a form a bent bar that protrude from the base. The protrusions, however, are not limited to a form of a bent bar. For example, the protrusions may be a straight bar, or they may be on a form of a blade. The protrusions may be in any form that may effectively separate clumped pieces of ice into individual ice pieces.

While in this embodiment, the ice separating device 750 is centered at the rear wall 712, in other embodiments, the ice separating device 750 may be off-set from the center of the rear wall 712. The ice separating device 750 may be positioned at the portion of the rear wall 712 where the ice separating device 750 may effectively separate clumped pieces of ice into separate individual pieces of ice. The base 754 of the ice separating device 750 may be rotatably disposed at the rear wall 712. When the base 754 of the ice separating device 750 rotates, the bent bars 752 fixed to the base 754 rotates with the base 754 to make impact with the clumped pieces of ice and separate the clumped ice into individual pieces of ice.

In this embodiment, the ice separating device 750 draws its power from a drive motor that rotates a plurality of blades 762. For instance the drive motor may be the drive motor 201 (See FIG. 1). The manner the drive motor 201 is coupled to the plurality of blades has been described with reference to FIG. 3. The drive motor 201 may be activated by a controller, which may be located in the refrigerator. Referring now to FIG. 20, according to this embodiment, the ice separating device 750 rotates from a shaft that is different from the rotary shaft that rotates the plurality of blades. The base 754 of the ice separating device 750 includes a gear 756 that is rotatably disposed at the rear wall 712 via the shaft connecting the ice separating device 750 and may be covered with a gear cover 758 (See FIG. 19). Another gear 766 is rotatably disposed at the rear wall 712 with the plurality of crushing blades 762. The teeth of the gear 766 disposed with the plurality of crushing blades 762 meshes with the teeth of the gear 756 of the ice separating device 750. Accordingly, when the drive motor that drives the plurality of blades 762 is energized, the drive motor also drives the gear 766 which engages and drives the gear 756 of the ice separating device 750. When the gear 756 is driven, the gear 756 causes the ice separating device 750 to rotate about its axis. In another embodiment, the drive motor may be attached to the ice separating device 750 to rotate the base. When the base is driven the gear 756 engages and drives the gear 766 coupled with the plurality of blades 762. As the gear 766 is driven, the gear 766 causes the plurality of blades 762 to rotate about its axis. In yet another embodiment, the ice separating device and the plurality of blades may be driven by separate drive motors. In another embodiment, gears may be replaced with a belt driven device. For instance, the ice separating device and the plurality of blades may be coupled together using a belt. An operation of the configuration shown in FIGS. 19 and 20 will now be described.

In the embodiment shown in FIGS. 19 and 20, the drive motor is coupled to the gear 766 disposed with the plurality of blades 762. When the drive motor is energized, the drive motor causes the gear 766 and the plurality of blades 762 to rotate. The teeth of the gear 766 is meshed with the teeth of the gear 756 of the ice separating device 750. Thus, as the gear 766 rotates the gear 766 drives and rotates the ice separating device 750. As the ice separating device 750 rotates the bent bars 752 fixed to the base 754 of the ice separating device 750 rotates and separates any clumped pieces of ice that the bent bars encounters into individual pieces of ice. In one embodiment, a bar such as the bar 642 described above with reference to FIGS. 14-16 may be disposed in the ice storage bin to aid in breaking clumped pieces of ice into individual pieces of ice in a manner as described with reference to FIGS. 14-16.

An ice separation device using various embodiments has been described above. It will be apparent to those skilled in the art that various modifications and variations can be made without departing from the spirit or scope of the inventions. Thus, the modifications and variations are intended to be covered by the appended claims and their equivalents.

What is claimed is:

1. A refrigerator comprising:

an ice maker to make pieces of ice;

an ice storage bin to receive the pieces of ice made by the ice maker;

a plurality of blades rotatably disposed at a bottom portion of the ice storage bin; and an ice separating device to separate clumped pieces of ice discharged from the ice maker, the ice separating device disposed in the ice storage bin between the ice maker and the plurality of blades, wherein the ice separating device is disposed on at least a rear wall, a front wall, or a side wall of the ice storage bin, wherein the ice separating device comprises a first bar disposed between the rear wall and the front wall, and wherein the plurality of blades can rotate in a forward direction and the first bar is extended toward another direction such that the plurality of blades does not rotate in the other direction.

2. The refrigerator according to claim 1, wherein the first bar is disposed at a position in the ice storage bin such that the first bar makes contact with the clumped pieces of ice discharged from the ice maker.

3. The refrigerator according to claim 2, wherein the ice separating device further comprises a second bar disposed between the rear wall and the front wall.

4. The refrigerator according to claim 3, wherein the second bar is disposed lower than the first bar in the ice storage bin.

5. The refrigerator according to claim 4, wherein the second bar is disposed between the first bar and the side wall.

6. The refrigerator according to claim 1, wherein a second bar is disposed close to the plurality of blades.

7. The refrigerator according to claim 6, further comprising:

a storage chamber;

a door adapted to open and close the storage chamber, wherein the ice storage bin is mounted at the door;

a rotary shaft connected to the plurality of rotary blades;

a drive motor provided at the door, wherein the drive motor drives the plurality of rotary blades to rotate in one of a first direction or a second direction through the rotary shaft.

8. The refrigerator according to claim 7, wherein an axis of the second bar is not perpendicular to the rotary shaft.

9. The refrigerator according to claim 8, wherein the axis of the second bar is parallel to the rotary shaft.

10. The refrigerator according to claim 6 further comprising:

the drive motor to drive the plurality of blades in a rotational direction such that the plurality of blades deflects the clumped pieces of ice to the second bar; and a controller to activate and deactivate the drive motor.

11. A refrigerator comprising:

a drive motor;

an ice maker to make pieces of ice;

an ice storage bin to receive the pieces of ice made by the ice maker;

a plurality of blades rotatably disposed at a wall of the ice storage bin; and an ice separating device to separate clumped pieces of ice in the ice storage bin, the ice separating device disposed in the ice storage bin between the ice maker and the plurality of blades, wherein the ice separating device is disposed on the same wall as the plurality of blades, and the ice separating device and the plurality of blades are driven together by the drive motor, the ice separating device having a protrusion toward inner space of the ice storage bin, wherein the plurality of blades can rotate in a forward direction and the protrusion is extended to another direction such that the plurality of blades does not rotate in the other direction.

12. The refrigerator according to claim 11, wherein the plurality of blades and the ice separating device is disposed on a rear wall of the ice storage bin.

13. The refrigerator according to claim 12, wherein the ice separating device further comprises:

a rotatable base having a face facing towards a front wall of the ice storage bin;

wherein the protrusion protrudes from the face of the base.

14. The refrigerator according to claim 13, wherein the protrusion protruding from the ice separating device comprises a bar.

15. The refrigerator according to claim 14, wherein the bar is bent.

16. The refrigerator according to claim 11, further comprising:

a storage chamber;

a door adapted to open and close the storage chamber, wherein the ice storage bin is mounted at the door;

a rotary shaft that is connected to the plurality of rotary blades;

the drive motor provided at the door, wherein the drive motor drives the plurality of rotary blades and the ice separating device to rotate in one of a first direction or a second direction through the rotary shaft.

17. The refrigerator according to claim 16, wherein a rotary shaft connected to the ice separating device is different from the rotary shaft connected to the plurality of blades.

18. The refrigerator according to claim 16, wherein the ice separating device and the plurality of blades are coupled together by gears.

19. The refrigerator according to claim 11, further comprising a bar disposed between the ice separating device and a side wall.

* * * * *